US009737453B2

(12) United States Patent
Shimada et al.

(10) Patent No.: US 9,737,453 B2
(45) Date of Patent: Aug. 22, 2017

(54) WALK TRAINING APPARATUS AND WALK TRAINING METHOD THEREOF

(71) Applicant: TOYOTA JIDOSHA KABUSHIKI KAISHA, Toyota-shi, Aichi-ken (JP)

(72) Inventors: Hiroshi Shimada, Tajimi (JP); Masayuki Imaida, Ichinomiya (JP); Hitoshi Konosu, Nagoya (JP); Yoshinori Fujikake, Nagakute (JP); Eiichi Saitoh, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/715,124

(22) Filed: May 18, 2015

(65) Prior Publication Data

US 2015/0342820 A1 Dec. 3, 2015

(30) Foreign Application Priority Data

May 27, 2014 (JP) ..... 2014-109470

(51) Int. Cl.
*A63B 22/00* (2006.01)
*A61H 3/00* (2006.01)
(Continued)

(52) U.S. Cl.
CPC ..... *A61H 3/008* (2013.01); *A61H 1/024* (2013.01); *A61H 1/0266* (2013.01);
(Continued)

(58) Field of Classification Search
CPC ..... A63B 22/00; A63B 22/02–22/0264; A63B 21/04–21/0557; A63B 21/4011;
(Continued)

(56) References Cited

U.S. PATENT DOCUMENTS 4,724,827 A * 2/1988 Schenck ..... A61H 1/0288 601/40
5,062,632 A 11/1991 Dalebout et al.
(Continued)

FOREIGN PATENT DOCUMENTS

CN 101862255 B 9/2011
DE 202010015329 U1 2/2011
(Continued)

OTHER PUBLICATIONS

Apr. 27, 2017 Notice of Allowance issued in U.S. Appl. No. 14/817,743.

*Primary Examiner* — Stephen R Crow
*Assistant Examiner* — Garrett Atkinson
(74) *Attorney, Agent, or Firm* — Oliff PLC

(57) ABSTRACT

A walk training apparatus includes a walking assist device, a first tensile portion, and a second tensile portion. The walking assist device is configured to be attached to a leg of a user so as to assist the user in walking. The first tensile portion pulls at least one of the walking assist device and the leg of the user toward a vertically upper side and toward a front side. The second tensile portion pulls at least one of the walking assist device and the leg of the user toward the vertically upper side and toward a rear side.

12 Claims, 6 Drawing Sheets

(51) Int. Cl.

| | |
|---|---|
| ***A63B 69/00*** | (2006.01) |
| ***A63B 22/02*** | (2006.01) |
| ***A63B 21/00*** | (2006.01) |
| ***A61H 1/02*** | (2006.01) |
| *A63B 24/00* | (2006.01) |

(52) U.S. Cl.
CPC ..... *A63B 21/4011* (2015.10); *A63B 22/0046* (2013.01); *A63B 22/0087* (2013.01); *A63B 22/02* (2013.01); *A63B 69/0028* (2013.01); *A61H 2201/0192* (2013.01); *A61H 2201/164* (2013.01); *A61H 2201/165* (2013.01); *A61H 2201/1635* (2013.01); *A61H 2201/5043* (2013.01); *A61H 2201/5061* (2013.01); *A63B 2024/0093* (2013.01)

(58) Field of Classification Search
CPC .. A63B 69/0028; A61H 3/008; A61H 1/0262; A61H 2201/1642; A61H 2201/50
USPC ..... 482/51, 54, 69, 92, 121–130
See application file for complete search history.

(56) References Cited

U.S. PATENT DOCUMENTS

| | | | | |
|---|---|---|---|---|
| 5,667,461 | A * | 9/1997 | Hall | A61H 1/0229 472/15 |
| 6,666,831 | B1 * | 12/2003 | Edgerton | A61H 1/0237 600/587 |
| 6,676,569 | B1 | 1/2004 | Radow | |
| 6,796,926 | B2 * | 9/2004 | Reinkensmeyer | A61B 5/1038 482/51 |
| 6,821,233 | B1 | 11/2004 | Colombo et al. | |
| 7,331,906 | B2 * | 2/2008 | He | A61H 1/0237 482/69 |
| 7,494,450 | B2 * | 2/2009 | Solomon | A61H 1/0229 482/51 |
| 7,887,471 | B2 * | 2/2011 | McSorley | A63B 21/0552 482/136 |
| 7,998,040 | B2 * | 8/2011 | Kram | A63B 21/00181 482/124 |
| 8,057,410 | B2 * | 11/2011 | Angold | A61H 3/00 601/35 |
| 8,095,209 | B2 | 1/2012 | Flaherty | |
| 8,147,436 | B2 | 4/2012 | Agrawal et al. | |
| 8,308,618 | B2 | 11/2012 | Bayerlein et al. | |
| 8,382,646 | B2 | 2/2013 | Schoenenberger | |
| 8,562,548 | B2 | 10/2013 | Shimada et al. | |
| 8,568,340 | B2 | 10/2013 | Endo | |
| 8,608,479 | B2 * | 12/2013 | Liu | A61H 1/024 434/255 |
| 8,920,347 | B2 | 12/2014 | Bayerlein et al. | |
| 9,314,393 | B2 | 4/2016 | Kim et al. | |
| 2003/0064869 | A1 * | 4/2003 | Reinkensmeyer | A61B 5/1038 482/100 |
| 2004/0087418 | A1 * | 5/2004 | Eldridge | A63B 21/157 482/54 |
| 2004/0204294 | A2 * | 10/2004 | Wilkinson | A63B 22/0005 482/54 |
| 2005/0101448 | A1 * | 5/2005 | He | A61H 1/0237 482/54 |
| 2008/0242511 | A1 | 10/2008 | Munoz et al. | |
| 2008/0300118 | A1 * | 12/2008 | Wehrell | A63B 21/04 482/129 |
| 2010/0130336 | A1 | 5/2010 | McSorley | |
| 2012/0071797 | A1 | 3/2012 | Aoki et al. | |
| 2012/0108392 | A1 | 5/2012 | Chu et al. | |
| 2013/0012852 | A1 | 1/2013 | Imaida et al. | |
| 2013/0130866 | A1 * | 5/2013 | Wehrell | A63B 21/1403 482/5 |
| 2013/0225370 | A1 | 8/2013 | Flynt et al. | |
| 2013/0225371 | A1 * | 8/2013 | Harrer | A63B 21/0552 482/8 |
| 2013/0226048 | A1 | 8/2013 | Unluhisarcikli et al. | |
| 2014/0058299 | A1 | 2/2014 | Sankai et al. | |
| 2014/0378279 | A1 | 12/2014 | Park et al. | |
| 2015/0306440 | A1 | 10/2015 | Bucher et al. | |
| 2015/0342819 | A1 | 12/2015 | Shimada et al. | |
| 2016/0051859 | A1 | 2/2016 | Nakashima et al. | |
| 2016/0136477 | A1 | 5/2016 | Bucher et al. | |
| 2016/0144226 | A1 | 5/2016 | Artemiadis et al. | |
| 2016/0150999 | A1 | 6/2016 | Sugata | |
| 2016/0158593 | A1 | 6/2016 | Craig et al. | |

FOREIGN PATENT DOCUMENTS

| | | | |
|---|---|---|---|
| GB | 2499675 | A | 8/2013 |
| JP | H06-15658 | U | 3/1994 |
| JP | 2005-211086 | A | 8/2005 |
| JP | 2006-006384 | A | 1/2006 |
| JP | 2007-185246 | A | 7/2007 |
| JP | 2009-183657 | A | 8/2009 |
| JP | 3155741 | U | 12/2009 |
| JP | 2012-095793 | A | 5/2012 |
| JP | 2013-543749 | A | 12/2013 |
| JP | 2015-223295 | A | 12/2015 |
| KR | 101289005 | B1 | 7/2013 |
| WO | 2012/118143 | A1 | 9/2012 |
| WO | 2013/119001 | A1 | 8/2013 |
| WO | 2014/001853 | A1 | 1/2014 |

* cited by examiner

WALK TRAINING APPARATUS AND WALK TRAINING METHOD THEREOF

INCORPORATION BY REFERENCE

The disclosure of Japanese Patent Application No. 2014-109470 filed on May 27, 2014 including the specification, drawings and abstract is incorporated herein by reference in its entirety.

BACKGROUND OF THE INVENTION

1. Field of the Invention

The present invention relates to a walk training apparatus for a user to perform walking training, and to a walk training method thereof.

2. Description of Related Art

There has been known a walk training apparatus including a band that assists swinging of a leg of a user who walks on a treadmill, by pulling the leg forward (see Japanese Patent Application Publication No. 2009-183657 (JP 2009-183657 A)).

However, the walk training apparatus assists only a forward action of the leg. Accordingly, in a case where a walking assist device that assists the walk of the user is attached to the leg of the user, for example, a walk load to the user may increase due to a weight of the walking assist device.

SUMMARY OF THE INVENTION

The present invention provides a walk training apparatus and a walk training method thereof each of which can reduce a walk load to a user in walking training.

One aspect of the present invention relates to a walk training apparatus including: a walking assist device configured to be attached to a leg of a user so as to assist the user in walking; a first tensile portion configured to pull at least one of the walking assist device and the leg of the user toward a vertically upper side and toward a front side; and a second tensile portion configured to pull at least one of the walking assist device and the leg of the user toward the vertically upper side and toward a rear side. In the above aspect, the walk training apparatus may further include a controlling portion configured to independently control a tensile force of the first tensile portion and a tensile force of the second tensile portion, respectively. In the above aspect, the controlling portion may independently control a resultant force of a vertically upward component of the tensile force of the first tensile portion and a vertically upward component of the tensile force of the second tensile portion, and a resultant force of a horizontal component of the tensile force of the first tensile portion and a horizontal component of the tensile force of the second tensile portion, respectively. In the above aspect, the resultant force of the vertically upward component of the tensile force of the first tensile portion and the vertically upward component of the tensile force of the second tensile portion may be equal to a gravity of the walking assist device. In the above aspect, that upper leg frame of the walking assist device which is attached to an upper leg of the leg of the user and/or that lower leg frame of the walking assist device which is attached to a lower leg of the leg of the user may be provided with a plurality of adjustment frames aligned in a vertically up-down direction; and a wire pulled by the first tensile portion and a wire pulled by the second tensile portion may be connected to any one of the plurality of adjustment frames. In the above aspect, each of the first tensile portion and the second tensile portion may include a wire having one end attached to at least one of the walking assist device and the leg of the user, and a wire tensile portion configured to pull the wire. In the above aspect, at least one of the wire tensile portion of the first tensile portion and the wire tensile portion of the second tensile portion may be provided in a movable manner in a right-left direction. In the above aspect, tensile points of the walking assist device by the first tensile portion and the second tensile portion and/or tensile points of the leg of the user by the first tensile portion and the second tensile portion may be provided around the leg of the user in a movable manner. One aspect of the present invention may be a walk training method of a walk training apparatus including a walking assist device configured to be attached to a leg of a user so as to assist the user in walking, and the walk training method may include: pulling at least one of the walking assist device and the leg of the user toward a vertically upper side and toward a front side; and pulling at least one of the walking assist device and the leg of the user toward the vertically upper side and toward a rear side.

According to the present invention, it is possible to provide a walk training apparatus and a walk training method thereof each of which can reduce a walk load to a user in walking training.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
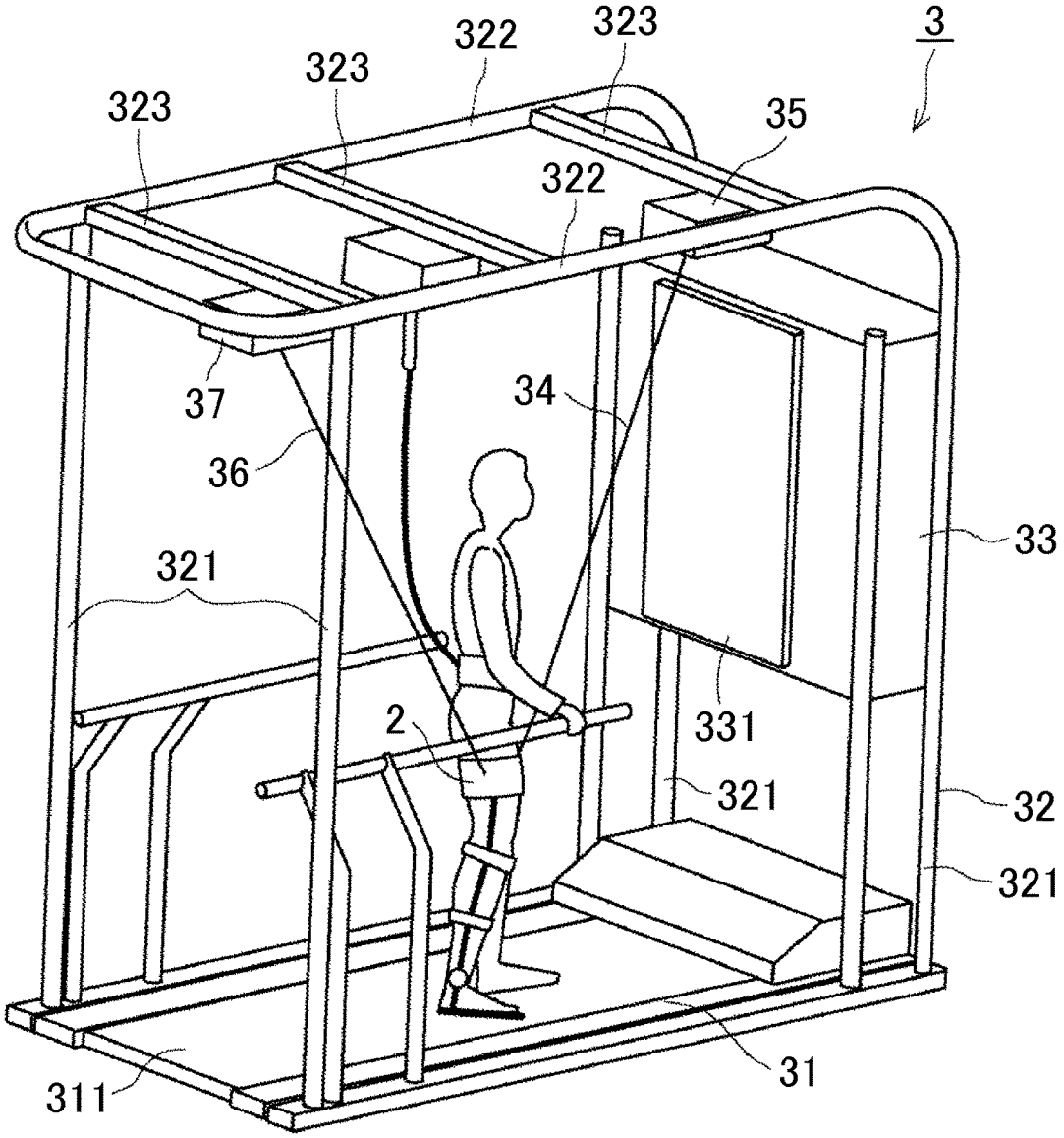
FIG. 1 is a perspective view illustrating a schematic configuration of a walk training apparatus according to one embodiment of the present invention.

With reference to drawings, the following describes embodiments of the present invention. FIG. 1 is a perspective view illustrating a schematic configuration of a walk training apparatus according to one embodiment of the present invention. A walk training apparatus 1 according to the present embodiment is an apparatus for a user, such as a patient with hemiparesis after stroke, to perform walking training, for example. The walk training apparatus 1 includes a walking assist device 2 attached to a leg of the user, and a training device 3 that performs the walking training of the user.

Figure 2:
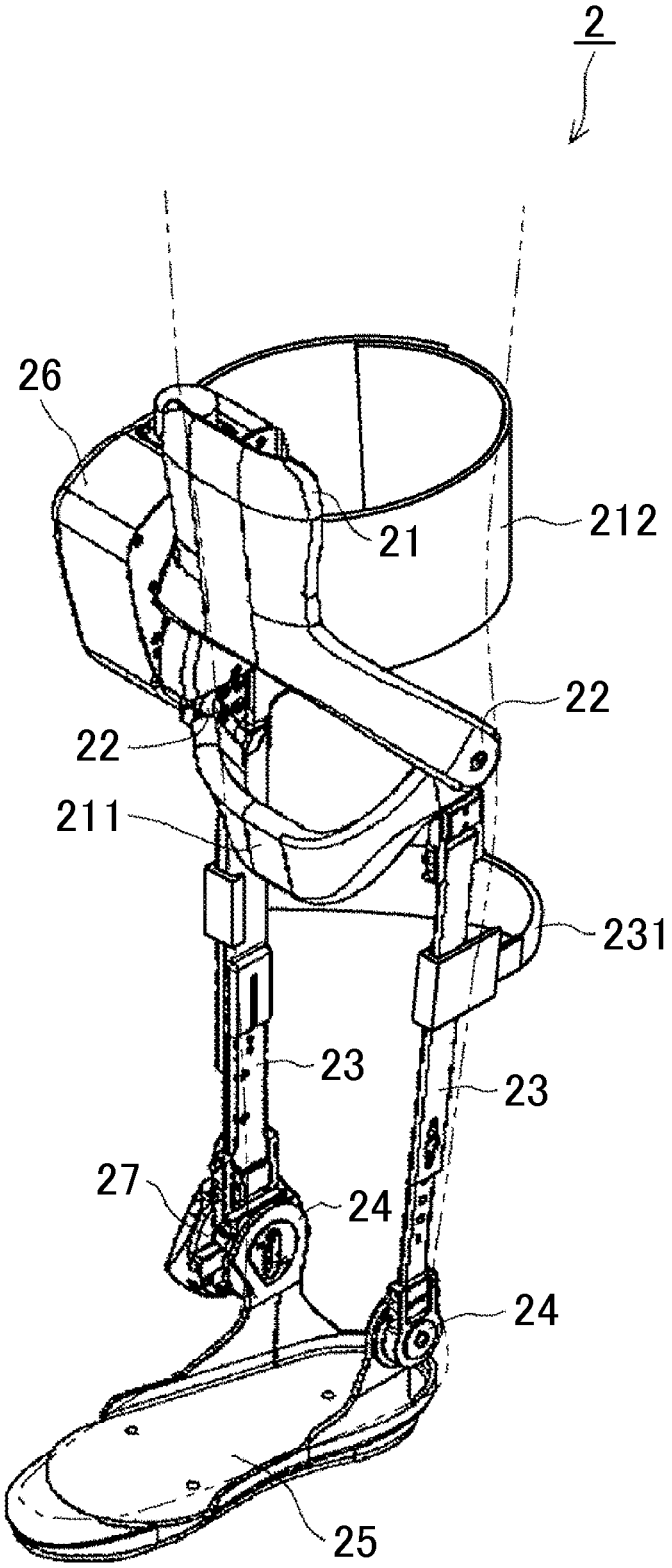
FIG. 2 is a perspective view illustrating a schematic configuration of a walking assist device according to one embodiment of the present invention.

The walking assist device 2 is attached to the leg of the user who performs the walking training so as to assist the walk of the user, for example (FIG. 2). The walking assist device 2 includes an upper leg frame 21, a lower leg frame 23 connected to the upper leg frame 21 via a knee joint portion 22, a sole frame 25 connected to the lower leg frame 23 via an ankle joint portion 24, a motor unit 26 configured to rotationally drive the knee joint portion 22, and an adjustment mechanism 27 configured to adjust a movable range of the ankle joint portion 24. Note that the configuration of the walking assist device 2 is an example, and the walking assist device 2 is not limited to this. For example, the walking assist device 2 may include a motor unit configured to rotationally drive the ankle joint portion 24.

The upper leg frame 21 is attached to an upper leg of the leg of the user, and the lower leg frame 23 is attached to a lower leg of the leg of the user. The upper leg frame is provided with an upper leg brace 212 configured to fix the upper leg, for example. The upper leg brace 212 is fixed to the upper leg by use of a hook and loop fastener, so-called magic tape (registered trademark), or the like, for example. This makes it possible to prevent the walking assist device 2 from displacing toward a right-left direction or toward a vertically up-down direction from the leg of the user.

The upper leg frame 21 is provided with an oblong first frame 211 extending in the right-left direction and configured such that a wire 34 of the after-mentioned first tensile portion 35 is connected thereto. The lower leg frame 23 is provided with an oblong second frame 231 extending in the right-left direction and configured such that a wire 36 of the after-mentioned second tensile portion 37 is connected thereto.

Note that connecting portions of the first and second tensile portions are an example, and the first and second tensile portions are not limited to them. For example, the wires 34, 36 of the first and second tensile portions 35, 37 may be connected to the upper leg brace 212, and tensile points of the first and second tensile portions 35, 37 can be provided at given positions of the walking assist device 2.

The motor unit 26 rotationally drives the knee joint portion 22 according to a walking action of the user, so as to assist the walk of the user. Note that the configuration of the walking assist device 2 is an example, and the walking assist device 2 is not limited to this. Any walking assist device configured to be attached to the leg of the user so as to assist the walk of the user is applicable.

The training device 3 includes a treadmill 31, and a frame main body 32, and a control device 33. The treadmill 31 rotates a ring-shaped belt 311. The user gets on the belt 311, and walks according to movement of the belt 311, so as to perform walking training.

The frame main body 32 includes two pairs of pole frames 321 provided on the treadmill 31 in a standing manner, a pair of front-rear frames 322 connected to each of the pole frames 321 and extending in a front-rear direction, and three right-left frames 323 connected to each of the front-rear frames 322 and extending in the right-left direction. Note that the configuration of the frame main body 32 is an example, and the frame main body 32 is not limited to this. The frame main body 32 may have any frame configuration, provided that the after-mentioned first and second tensile portions 35, 37 can be fixed appropriately.

The front right-left frame 323 is provided with the first tensile portion 35 configured to pull the wire 34 toward a vertically upper side and toward a front side. The rear right-left frame 323 is provided with the second tensile portion 37 configured to pull the wire 36 toward a vertically upper side and toward a rear side.

The first and second tensile portions 35, 37 are each constituted, for example, by a mechanism to wind and rewind the wire 34, 36, a motor to drive the mechanism, and the like. One ends of the wires 34, 36 pulled by the first and second tensile portions 35, 37 are connected to the walking assist device 2. The first tensile portion 35 pulls the walking assist device 2 via the wire 34 toward the vertically upper side and toward the front side. The second tensile portion 37 pulls the walking assist device 2 via the wire 36 toward the vertically upper side and toward the rear side.

The first and second tensile portions 35, 37 control driving torques of the motors so as to control tensile forces of the wires 34, 36, but are not limited to this. For example, a spring member may be connected to each of the wires 34, 36, and adjust an elastic force of the spring member so as to adjust the tensile force of the each of the wires 34, 36.

The wire 34 extends from the walking assist device 2 of the leg of the user toward the vertically upper side and the front side, and the wire 36 extends from the walking assist device 2 of the leg of the user toward the vertically upper side and the rear side. Accordingly, the wires 34, 36 do not interfere with the user during the walk of the user, and do not disturb the walking training.

The control device 33 is one concrete example of a controlling portion, and controls tensile forces of the first and second tensile portions 35, 37, driving of the treadmill 31, and the walking assist device 2. The control device 33 has a hardware configuration mainly including a microcomputer constituted by a CPU (Central Processing Unit) that performs a computing process, a control process, and the like, a ROM (Read Only Memory) in which to store a computing program, a control program, and the like to be performed by the CPU, a RAM (random access memory) in which to store various data and the like, an interface portion (I/F) configured to perform input/output of a signal with respect to outside, and the like, for example. The CPU, ROM, RAM and interface portion are connected to each other via data buses and the like.

The control device 33 is provided with a display portion 331 configured to display information such as a training instruction, a training menu, and training information (walking speed, biological information, etc.). The display portion 331 is provided as a touch panel, for example, so that the user can input various information through the display portion 331.

In the meantime, when the user puts the walking assist device 2 on the leg to perform the walking training, a walk load may increase due to a weight of the walking assist device 2. Particularly, when the walking assist device 2 is attached to an affected leg of a patient with hemiparesis after stroke or the like, the patient has more difficulty at the time of lifting the affected leg, due to the weight of the walking assist device 2.

Figure 3:
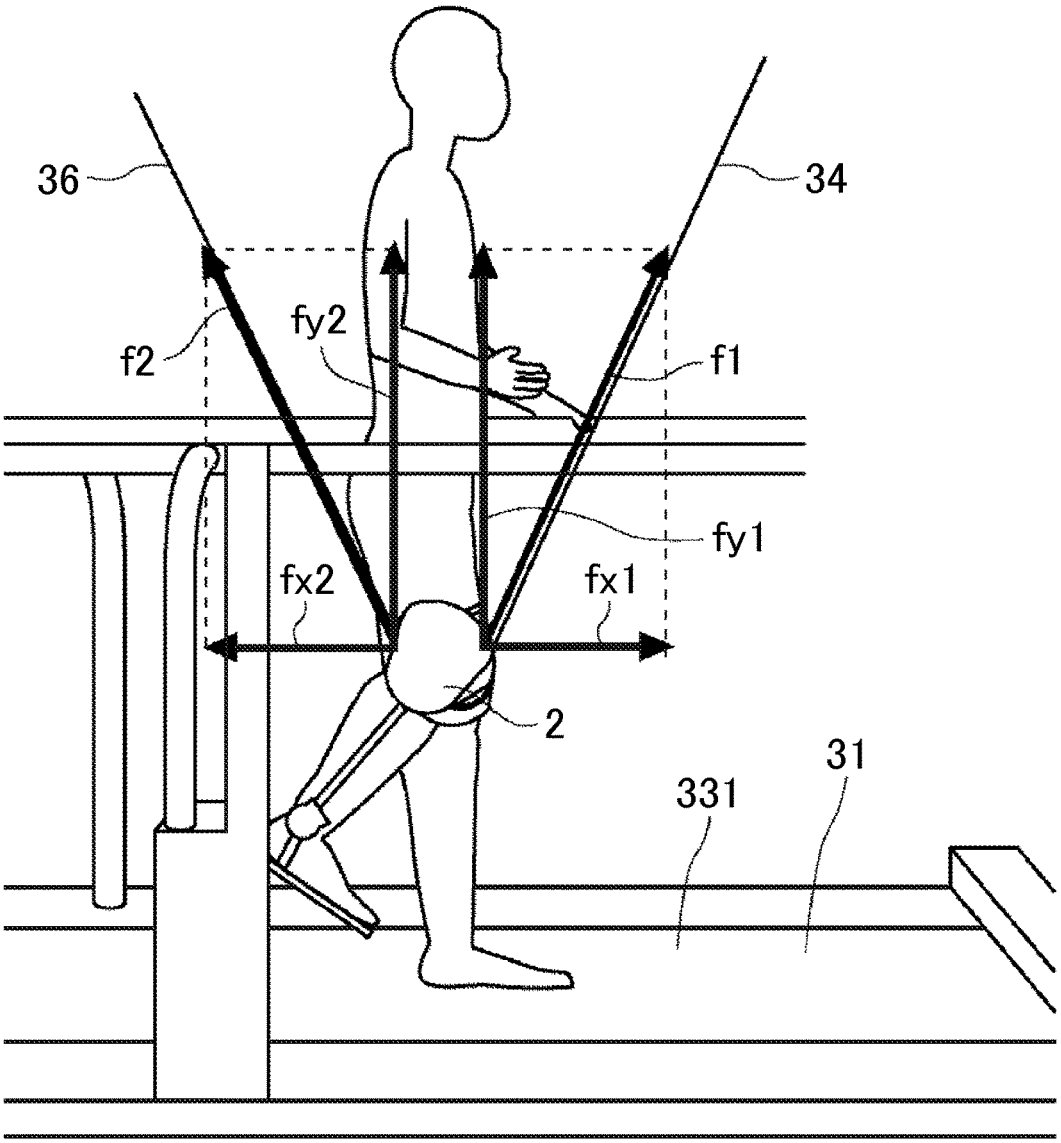
FIG. 3 is a view to describe tensile forces due to first and second tensile portions.

In contrast, in the walk training apparatus 1 according to the present embodiment, the first tensile portion 35 pulls the walking assist device 2 via the wire 34 toward the vertically upper side and toward the front side, and the second tensile portion 37 pulls the walking assist device 2 via the wire 36 toward the vertically upper side and toward the rear side. Vertically upward components fy1, fy2 of tensile forces f1, f2 due to the first and second tensile portions 35, 37 support the weight of the walking assist device 2. Then, horizontal components fx1, fx2 of the tensile forces f1, f2 due to the first and second tensile portions 35, 37 assist swinging of the leg. This can reduce the walk load to the user in the walking training (FIG. 3). For example, a patient such as the patient with hemiparesis after stroke can continue the walking training for a long time with the walking assist device 2 being attached to the leg, which leads to improvement of recovery efficiency.

Further, the tensile forces f1, f2 due to the first and second tensile portions 35, 37 limit the action of the leg within a single plane including a swinging direction of the leg to which the walking assist device 2 is attached and tensile directions. This can restrain internal rotation and external rotation of the leg, which leads to natural gait movement. For example, the affected leg tends to be easy to make internal rotation in an early period of rehabilitation and to be easy to make external rotation in a recovery period. The tensile forces f1, f2 of the first and second tensile portions 35, 37 can restrain the internal rotation of the affected leg in the early period of rehabilitation, and can restrain the external rotation of the affected leg in the recovery period. As a result, the internal rotation and the external rotation of the leg are restrained in the training for a long term, and more natural walking training can be performed.

The control device 33 controls the tensile forces of the first and second tensile portions 35, 37, so that a resultant force (fy1+fy2) of the vertically upward component of the tensile force due to the first tensile portion 35 and the vertically upward component of the tensile force due to the second tensile portion 37 becomes equal to a gravity of the walking assist device 2. The user can hereby perform more natural walking training without feeling the weight of the walking assist device 2 attached to the leg.

Further, the control device 33 may adjust a leg load-relief amount by controlling the tensile forces f1, f2 due to the first and second tensile portions 35, 37 so as to change the vertically upward components fy1, fy2. Hereby, it is possible to set a degree of difficulty of the walking training by adjusting the leg load-relief amount according to a recovery degree of the patient, for example.

The control device 33 decreases the leg load-relief amount by controlling the tensile forces f1, f2 of the first and second tensile portions 35, 37 so as to decrease the vertically upward components fy1, fy2 of the tensile forces. This increases a load of the walking assist device 2 to the affected leg, thereby increasing the degree of difficulty of the walking training.

The control device 33 may independently control the tensile force f1 of the first tensile portion 35 and the tensile force f2 of the second tensile portion 37, respectively. Hereby, the control device 33 can independently control a resultant force of the vertically upward component of the tensile force due to the first tensile portion 35 and the vertically upward component of the tensile force due to the second tensile portion 37, and a resultant force of the horizontal component of the tensile force due to the first tensile portion 35 and the horizontal component of the tensile force due to the second tensile portion 37, respectively. Accordingly, it is possible to independently adjust a vertically upward leg load-relief amount and a swinging assist amount in a front-rear direction, respectively.

Figure 4:
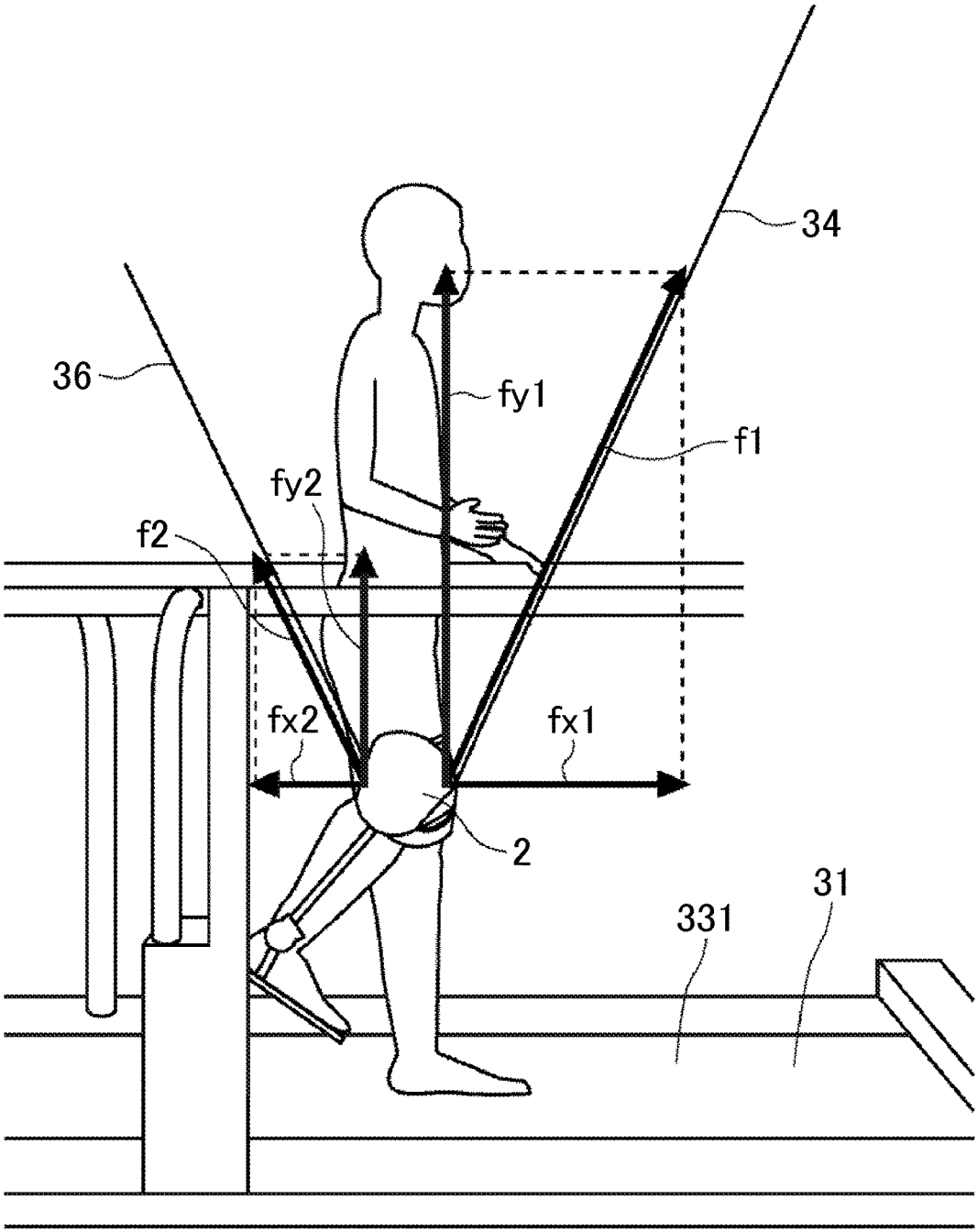
FIG. 4 is a view to describe the tensile forces due to the first and second tensile portions.

For example, as illustrated in FIG. 4, the control device 33 controls the tensile force f1 of the first tensile portion 35 to be larger than the tensile force f2 of the second tensile portion 37. In this case, the resultant force (fy1+fy2) of the vertically upward component of the tensile force of the first tensile portion 35 and the vertically upward component of the tensile force due to the second tensile portion 37 serves as the vertical upward leg load-relief amount, and a resultant force (fx1−fx2) of the horizontal component of the tensile force of the first tensile portion 35 and the horizontal component of the tensile force of the second tensile portion 37 serves as the swinging assist amount. As such, it is possible to appropriately set the leg load-relief amount and the swinging assist amount according to the user, thereby making it possible to improve walking training efficiency.

Figure 5:
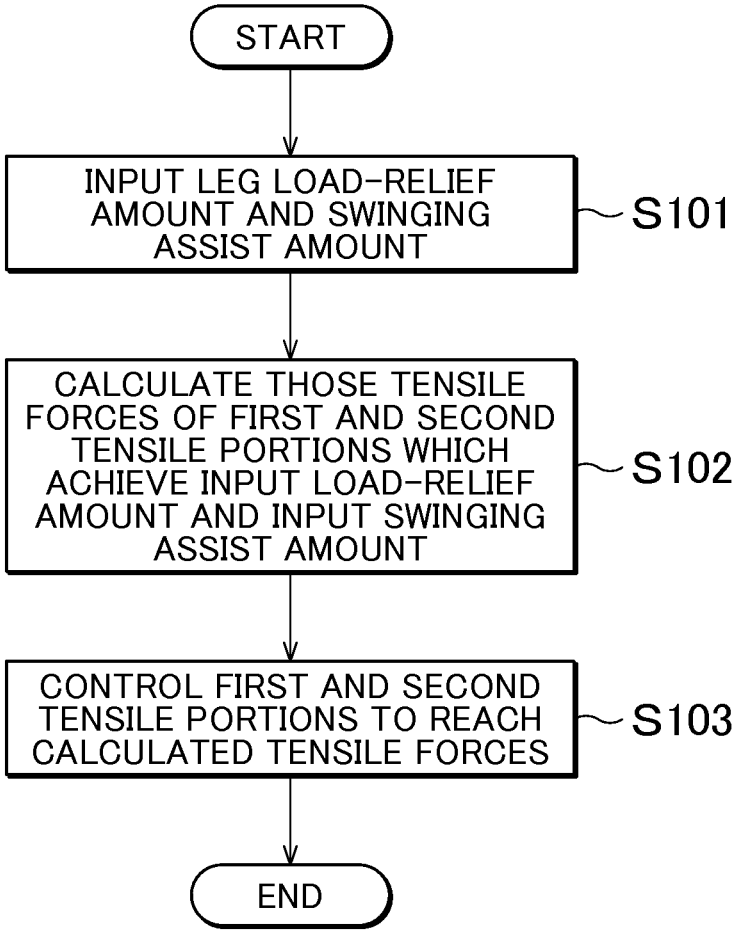
FIG. 5 is a flowchart illustrating a flow of a setting method of the tensile forces due to the first and second tensile portions.

FIG. 5 is a flowchart illustrating a flow of a setting method of the tensile forces due to the first and second tensile portions. The user inputs a leg load-relief amount F1 and a swinging assist amount F2 into the control device 33 (step S101).

The control device 33 calculates those tensile forces f1, f2 of the first and second tensile portions 35, 37 which achieve the input leg load-relief amount (F1=fy1+fy2) and the input swinging assist amount (F2=fx1−fx2) (step S102). The control device 33 controls the first and second tensile portions 35, 37 individually so that the first and second tensile portions 35, 37 pull the wires 34, 36 with the tensile forces f1, f2 thus calculated (step S103).

Thus, in the walk training apparatus 1 according to the present embodiment, the first tensile portion 35 pulls the walking assist device 2 via the wire 34 toward the vertically upper side and toward the front side, and the second tensile portion 37 pulls the walking assist device 2 via the wire 36 toward the vertically upper side and toward the rear side. This can reduce the walk load to the user in the walking training.

Note that the present invention is not limited to the above embodiment, and various modifications can be made within a range that does not deviate from a gist of the present invention.

Figure 6:
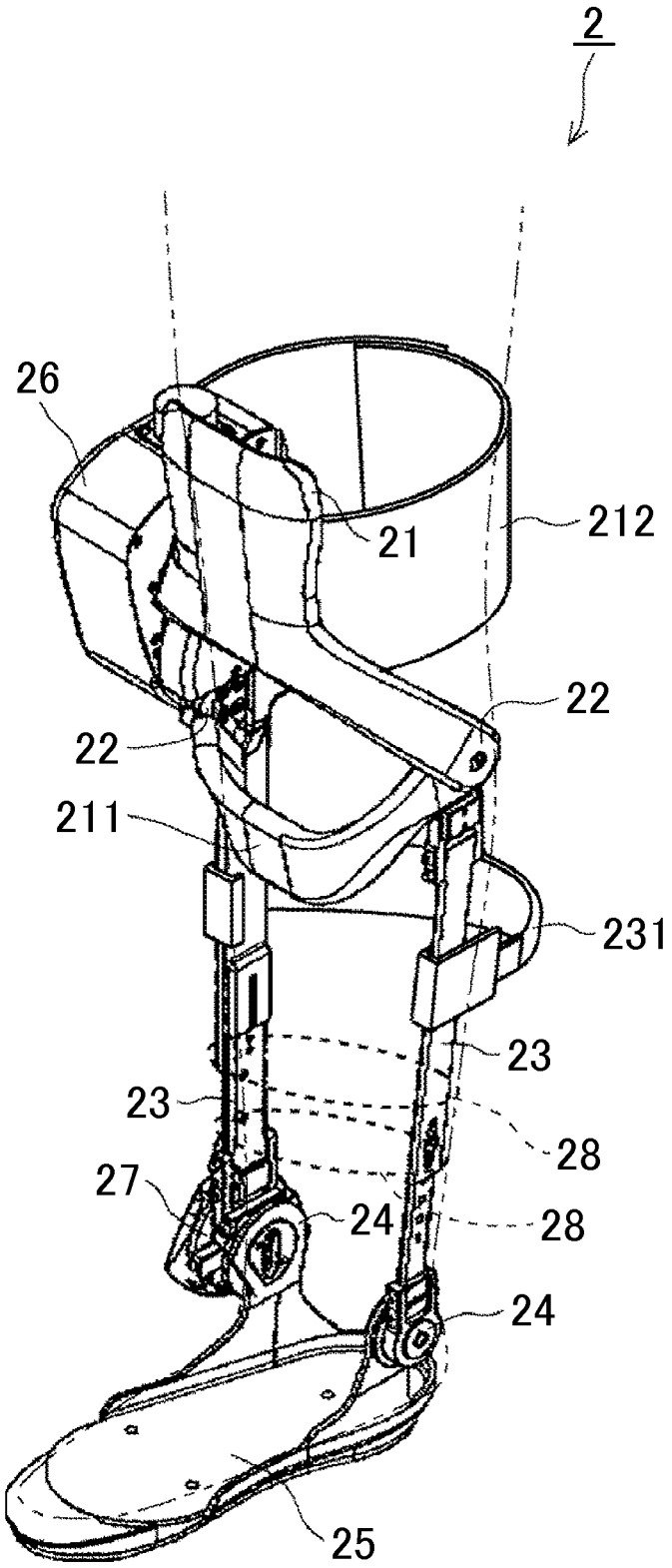
FIG. 6 is a view illustrating a walking assist device including a plurality of frames aligned in a vertically up-down direction.

In the above embodiment, the upper leg frame 21 and/or the lower leg frame 23 of the walking assist device 2 may be provided with a plurality of tonic adjustment frames 28, which is oblong in the right-left direction, and aligned in the vertically up-down direction (FIG. 6). The wires 34, 36 of the first and second tensile portions 35, 37 are connected to any one of the plurality of adjustment frames 28. By selecting a position of the adjustment frame 28 in the vertical up-down direction and connecting the wires 34, 36 of the first and second tensile portions 35, 37 thereto, it is possible to adjust a moment force in a pitch direction in the walking assist device 2. Accordingly, it is possible to adjust the swinging assist amount regardless of the vertically upward leg load-relief amount.

For example, when the wires 34, 36 of the first and second tensile portions 35, 37 are connected to an adjustment frame 28 on a vertically upper side, the moment force in the swinging direction can be decreased and the swinging assist amount can be decreased. In the meantime, when the wire 34 of the first tensile portion 35 is connected to an adjustment frame 28 on a lower side and the wire 36 of the second tensile portion 37 is connected to the adjustment frame 28 on the vertically upper side, the moment force in the swinging direction can be increased and the swinging assist amount can be increased.

In the above embodiment, the training device 3 may be configured so as not to include the frame main body 32. In this case, the first and second tensile portions 35, 37 may be provided on a wall surface or a ceiling, for example.

In the above embodiment, the wires 34, 36 of the first and second tensile portions 35, 37 are connected to the walking assist device 2, but the present invention is not limited to this. For example, the wires 34, 36 of the first and second tensile portions 35, 37 may be configured to be connected to the leg of the user via a mounting fixture such as a belt or a ring. Further, the wires 34, 36 of the first and second tensile portions 35, 37 may be configured to be connected to the walking assist device 2 and the leg of the user.

In the above embodiment, the tensile points of the walking assist device 2 by the first and second tensile portions 35, 37 may be provided around the leg of the user in a movable manner. When the tensile points of the first and second tensile portions 35, 37 are moved around the leg of the user and pulled, a moment force in an internal/external rotation direction can be caused to the leg. With the use of the moment force, an internal/external rotation control amount of the leg can be adjusted optimally.

In the above embodiment, at least one of the first and second tensile portions 35, 37 may be provided in the right-left frame 323 in a movable manner in the right-left direction. By moving the first and second tensile portions 35, 37 in the right-left direction, the internal/external rotation control amount of the leg to which the walking assist device 2 is attached can be adjusted optimally.

In the above embodiment, the user who puts on the walking assist device 2 walks on the treadmill 31. However, the present invention is not limited to this. The user who puts on the walking assist device 2 may walk on an immobile road surface and the first and second tensile portions 35, 37 may be configured to be moved according to movement of the user.

What is claimed is:

1. A walk training apparatus comprising:

a walking assist device configured to be attached to a leg of a user so as to assist the user during walking;

a treadmill on which the user can walk;

a first tensile portion configured to pull at least one of the walking assist device and the leg of the user toward a vertically upper side and toward a front side;

a second tensile portion configured to pull at least one of the walking assist device and the leg of the user toward the vertically upper side and toward a rear side; and a control device that includes a processor and a memory and is configured to control independently a tensile force of the first tensile portion and a tensile force of the second tensile portion such that:

(i) a resultant force of a vertically upward component of the tensile force of the first tensile portion and a vertically upward component of the tensile force of the second tensile portion and (ii) a resultant force of a horizontal component of the tensile force of the first tensile portion and a horizontal component of the tensile force of the second tensile portion are independently adjusted.

2. The walk training apparatus according to claim 1, wherein the resultant force of the vertically upward component of the tensile force of the first tensile portion and the vertically upward component of the tensile force of the second tensile portion is equal to a gravity of the walking assist device.

3. The walk training apparatus according to claim 1, wherein:

an upper leg frame of the walking assist device which is attachable to an upper part of the leg of the user or a lower leg frame of the walking assist device which is attachable to a lower part of the leg of the user is provided with a plurality of adjustment frames aligned in a vertically up-down direction; and a wire pulled by the first tensile portion and a wire pulled by the second tensile portion are connected to any one of the plurality of adjustment frames.

4. The walk training apparatus according to claim 1, wherein:

an upper leg frame of the walking assist device which is attachable to an upper part of the leg of the user and a lower leg frame of the walking assist device which is attachable to a lower part of the leg of the user are provided with a plurality of adjustment frames aligned in a vertically up-down direction; and a wire pulled by the first tensile portion and a wire pulled by the second tensile portion are connected to any one of the plurality of adjustment frames.

5. The walk training apparatus according to claim 1, wherein each of the first tensile portion and the second tensile portion includes a wire having one end attached to at least one of the walking assist device and the leg of the user, and a wire tensile portion configured to retract the wire.

6. The walk training apparatus according to claim 5, wherein at least one of the wire tensile portion of the first tensile portion and the wire tensile portion of the second tensile portion is provided in a movable manner in a right-left direction.

7. The walk training apparatus according to claim 1, further configured such that (i) a first tensile point of the walking assist device by the first tensile portion and a second tensile point of the walking assist device by the second tensile portion or (ii) a third tensile point of the leg of the user by the first tensile portion and a fourth tensile point of the leg of the user by the second tensile portion can be provided around the leg of the user in a movable manner.

8. The walk training apparatus according to claim 1, further configured such that (i) a first tensile point of the walking assist device by the first tensile portion, (ii) a second tensile point of the walking assist device by the second tensile portion, (iii) a third tensile point of the leg of the user by the first tensile portion, and (iv) a fourth tensile point of the leg of the user by the second tensile portion can be provided around the leg of the user in a movable manner.

9. A walk training method for a walk training apparatus including (i) a walking assist device configured to be attached to a leg of a user so as to assist the user during walking and (ii) a treadmill on which the user can walk, the walk training method comprising:

pulling, by a first tensile portion, at least one of the walking assist device and the leg of the user toward a vertically upper side and toward a front side, pulling, by a second tensile portion, at least one of the walking assist device and the leg of the user toward the vertically upper side and toward a rear side, and independently controlling, by a control device that includes a processor and a memory, a tensile force of the first tensile portion and a tensile force of the second tensile portion such that:

(i) a resultant force of a vertically upward component of the tensile force of the first tensile portion and a vertically upward component of the tensile force of the second tensile portion and (ii) a resultant force of a horizontal component of the tensile force of the first tensile portion and a horizontal component of the tensile force of the second tensile portion are independently adjusted.

10. The walk training apparatus according to claim 1, further comprising:

an ankle joint portion that connects a sole frame and a lower leg frame;

a first motor configured to drive the ankle joint portion;

a knee joint portion that connects the lower leg frame and an upper leg frame; and a second motor configured to drive the knee joint portion.

11. The walk training method according to claim 9, further comprising the steps of:

inputting a leg load-relief amount and a swinging assist amount into the control device; and calculating the tensile force for the first tensile portion and the tensile force for the second tensile portion based on the inputted leg load-relief amount and the swinging assist amount.

12. A walk training apparatus comprising:

a walking assist device configured to be attached to a leg of a user translating on a platform so as to assist the user during walking;

a first tensile portion configured to pull at least one of the walking assist device and the leg of the user toward a vertically upper side and toward a front side;

a second tensile portion configured to pull at least one of the walking assist device and the leg of the user toward the vertically upper side and toward a rear side; and a control device that includes a processor and a memory and is configured to control independently a tensile force of the first tensile portion and a tensile force of the second tensile portion such that:

(i) a resultant force of a vertically upward component of the tensile force of the first tensile portion and a vertically upward component of the tensile force of the second tensile portion and (ii) a resultant force of a horizontal component of the tensile force of the first tensile portion and a horizontal component of the tensile force of the second tensile portion are independently adjusted.

* * * * *